US007647936B1

(12) United States Patent
Chen

(10) Patent No.: US 7,647,936 B1
(45) Date of Patent: Jan. 19, 2010

(54) RUNNER ASSEMBLY FOR AN UMBRELLA FRAME

(76) Inventor: Hsia-Hui Chen, No. 7, Lane 41, Zihciang S. Rd., Jhubei City, Hsinchu County (TW)

( * ) Notice: Subject to any disclaimer, the term of this patent is extended or adjusted under 35 U.S.C. 154(b) by 0 days.

(21) Appl. No.: 12/455,988

(22) Filed: Jun. 10, 2009

(30) Foreign Application Priority Data

Dec. 16, 2008 (CN) ..... 2008 2 0189952 U

(51) Int. Cl.
*A45B 25/08* (2006.01)
*A45B 25/06* (2006.01)

(52) U.S. Cl. ..... 135/39; 135/38; 135/28

(58) Field of Classification Search ..... 135/28, 135/37–39, 42
See application file for complete search history.

(56) References Cited

U.S. PATENT DOCUMENTS 3,242,180 A * 3/1966 Andolfi ..... 544/314
5,515,878 A * 5/1996 Wu ..... 135/28
5,615,698 A * 4/1997 Ko ..... 135/28
6,758,229 B2 7/2004 Wang
6,941,960 B2 * 9/2005 Huang ..... 135/41
7,281,542 B2 10/2007 Ko
7,575,009 B2 * 8/2009 Chang ..... 135/28

* cited by examiner

*Primary Examiner*—David Dunn
*Assistant Examiner*—Danielle Jackson
(74) *Attorney, Agent, or Firm*—Knobbe Martens Olson & Bear LLP

(57) ABSTRACT

A runner assembly for use with a central shaft of an umbrella frame includes a tubular retaining block which is movable relative to a tubular runner in a transverse direction relative to an axis of the central shaft, and a tubular thrust member movable along the axis. An inner sleeve surface of the thrust member is configured such that, when the thrust member is pressed from a releasing position to an actuating position, the retaining block is moved from a first position to a second position to permit a retaining member disposed thereon to engage an engaging surface of the central shaft so as to keep the umbrella frame in an open state.

8 Claims, 7 Drawing Sheets

RUNNER ASSEMBLY FOR AN UMBRELLA FRAME

CROSS-REFERENCE TO RELATED APPLICATION

This application claims priority of Chinese Utility Model Application No. 200820189952.2, filed on Dec. 16, 2008, the disclosure of which is herein incorporated by reference.

BACKGROUND OF THE INVENTION

1. Field of the Invention

This invention relates to a runner assembly for an umbrella frame, more particularly to a runner assembly with a tubular thrust member which is operable to move a runner between upper and lower positions, and to retain the runner in the upper position.

2. Description of the Related Art

Referring to FIG. 1, a conventional runner assembly of an umbrella frame disclosed in U.S. Pat. No. 6,758,229 is shown to include a runner 2 which is slidable on a central shaft 1 that is formed with a protuberance having a shoulder 101, and a sleeve member 3 which surrounds and which is movable relative to the runner 2. The runner 2 has two radially biased retaining members 201 which can be depressed by a cam surface 301 of the sleeve member 3 so as to be retained on the shoulder 101 to thereby arrest the runner 2 in an opened position.

Referring to FIG. 2, another conventional runner assembly of an umbrella frame disclosed in U.S. Pat. No. 7,281,542 is shown to include a runner 4, two engaging slices 5 pivotally connected on the runner 4, and a sleeve 6 displaceably disposed around the runner 4. Each of the engaging slices 5 has a middle pivot portion 501 which is engaged with a groove 402 in the runner 4 such that an engaging end 502 thereof is pressed by an inner ring 601 into a hole 401 in the runner 4 to be retained on a shoulder of a central shaft (not shown) so as to keep the umbrella in an open state.

It is desirable to improve the aforesaid runner assembly to simplify the structure thereof, to render the same suitable for any known umbrella frames, and to permit a runner to be retained firmly on a shaft in an upper position.

SUMMARY OF THE INVENTION

An object of the present invention is to provide a runner assembly for use in an umbrella frame, which has a simple construction, which is suitable for any known umbrella frames, and which permits a runner thereof to be retained firmly on a shaft in an upper position.

According to this invention, the runner assembly includes a tubular runner, a tubular retaining block, a tubular thrust member, and a retaining member.

The runner includes upper and lower tubular ends spaced apart from each other along an axis to define an accommodation space there between. The accommodation space defines a guideway that extends in a first direction transverse to the axis.

The retaining block is disposed in the accommodation space to be guidingly movable along the guideway, and includes leading and trailing wall segments opposite to each other in the first direction. An outer leading surface of the leading wall segment has a bump region proximate to the lower tubular end. An outer trailing surface of the trailing wall segment has a follower region proximate to the upper tubular end.

The thrust member is movable relative to the runner and the retaining block along the axis between an actuating position, where the thrust member is close to the upper tubular end, and a releasing position, where the thrust member is remote from the upper tubular end. An inner sleeve surface of the thrust member includes actuating and complementary surface segments respectively confronting the outer trailing and leading surfaces in the first direction. The actuating surface segment has head and cam regions such that, when the thrust member is moved from the releasing position to the actuating position, the head region is brought to move over the follower region to permit the cam region to engage the follower region so as to shift the retaining block from a first position to a second position. The complementary surface segment has recessed and curb regions such that, when the retaining block is in the first position, the bump region abuts against the curb region, and such that, when the thrust member is moved from the releasing position to the actuating position, the bump region is brought to slip over the curb region to fall into the recessed region so as to permit the retaining block to be displaced to the second position.

The retaining member is disposed on an inner trailing surface of the trailing wall segment such that, when the retaining block is displaced to the second position, the retaining member is brought into engagement with an engaging surface of a central shaft of an umbrella frame.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
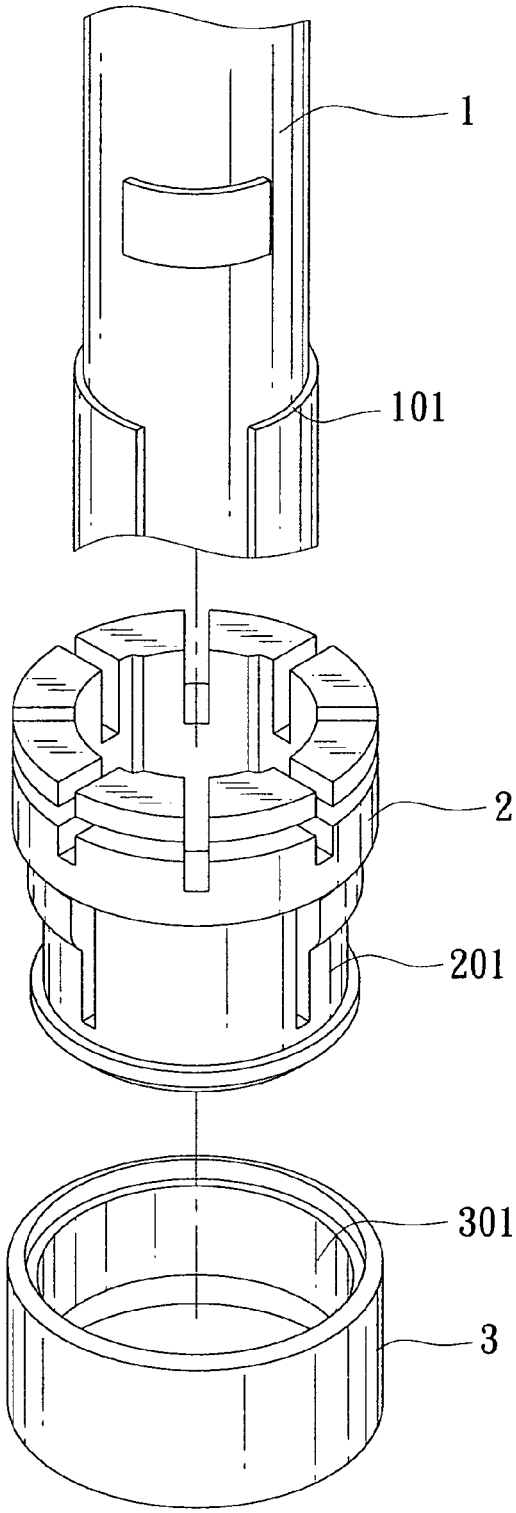
FIG. 1 PRIOR ART
FIG. 1 is an exploded perspective view of a conventional runner assembly.
Figure 2:
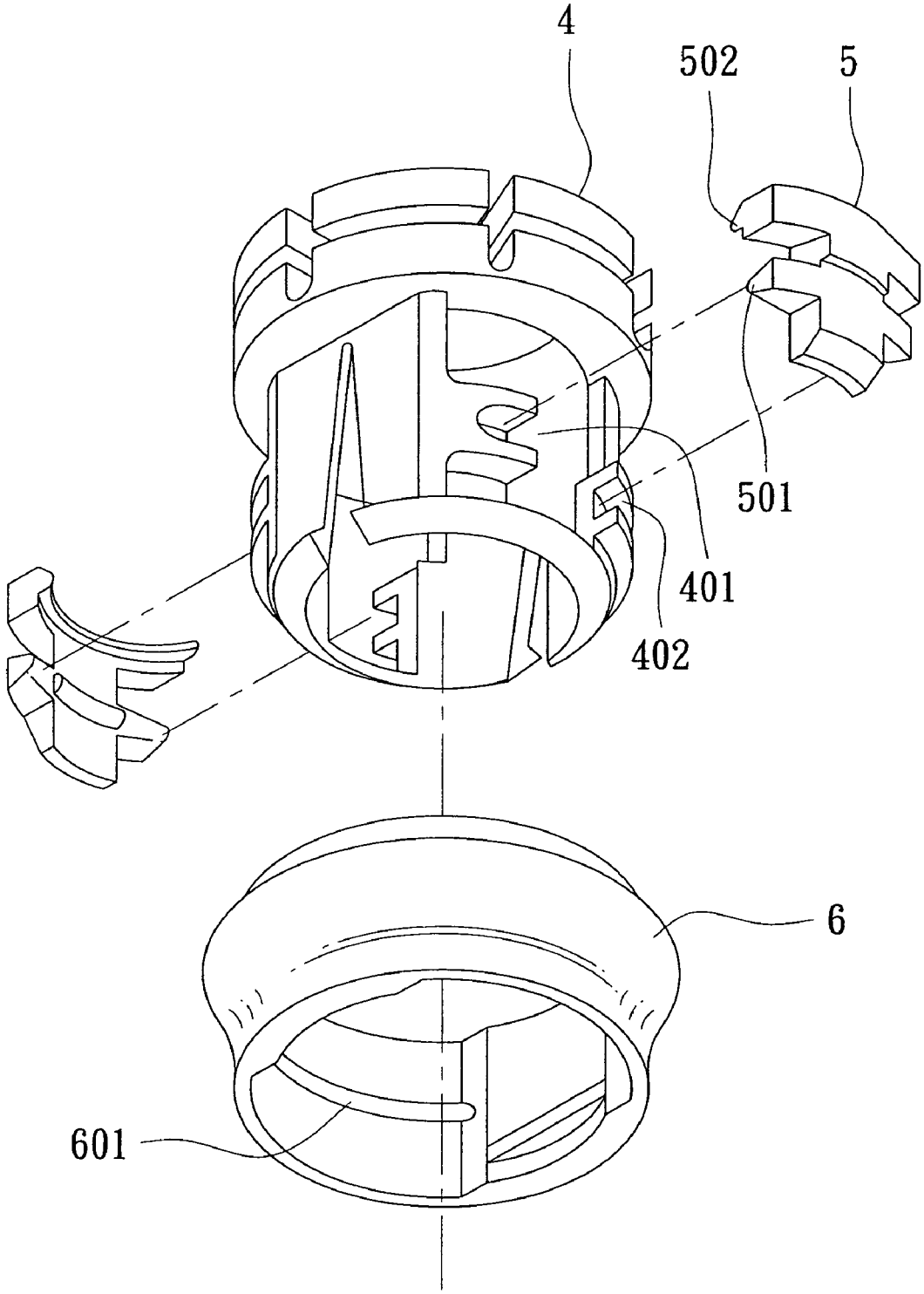
FIG. 2 PRIOR ART
FIG. 2 is an exploded perspective view of another conventional runner assembly.

Before the present invention is described in greater detail, it should be noted that same reference numerals have been used to denote like elements throughout the specification.

Figure 3:
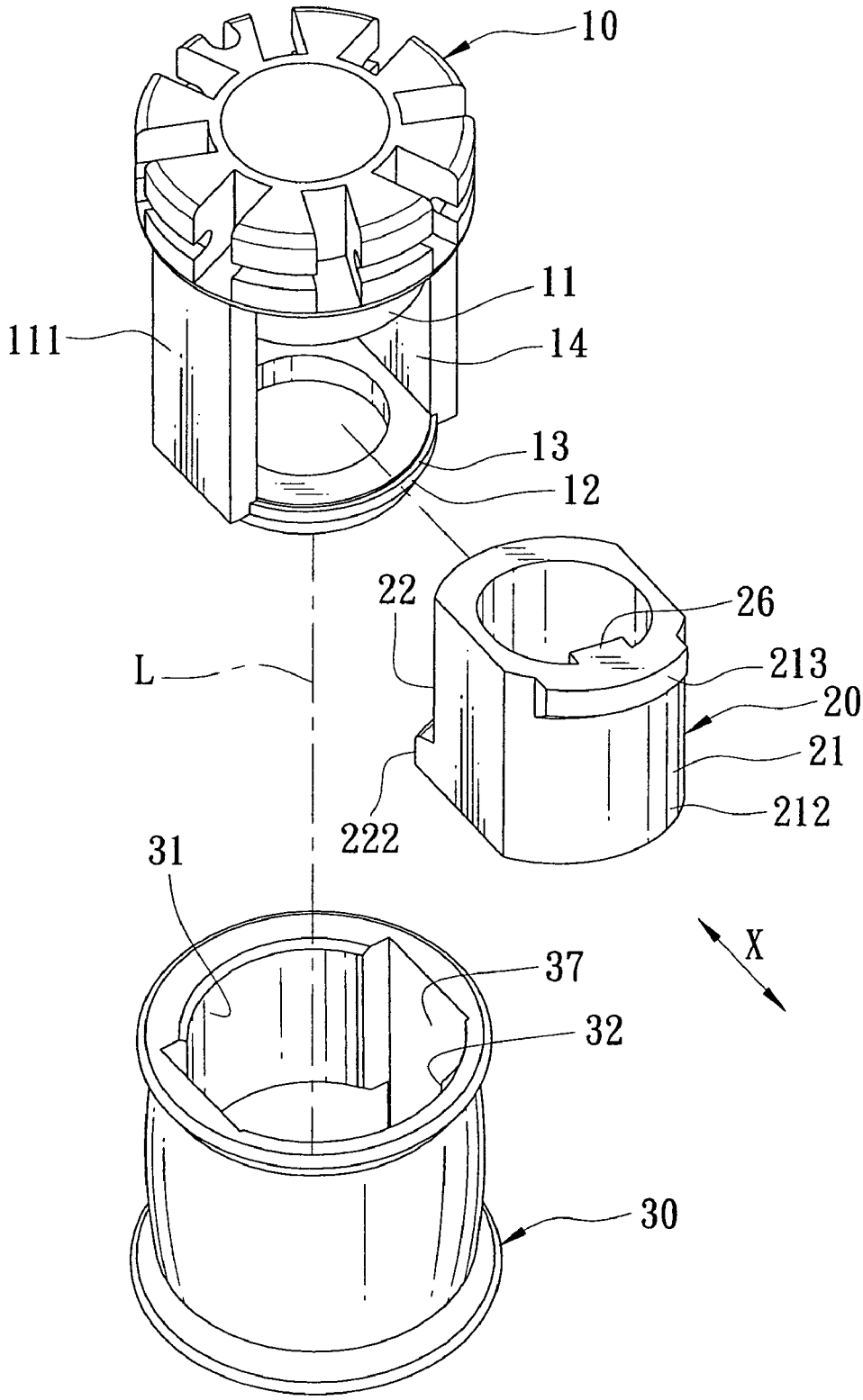
FIG. 3 is an exploded perspective view of the first preferred embodiment of a runner assembly according to this invention.
Figure 4:
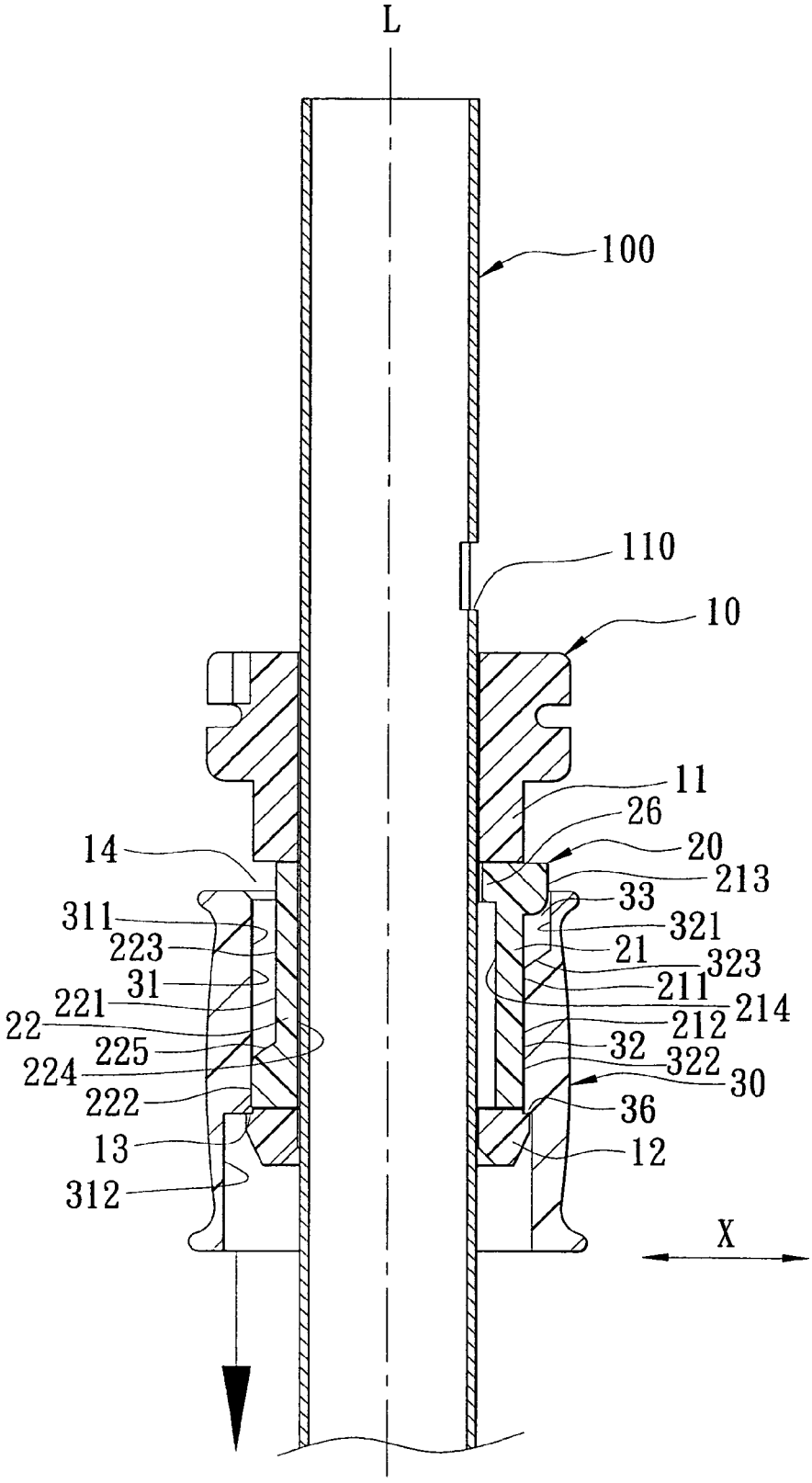
FIG. 4 is a sectional view of the first preferred embodiment, showing a runner in a lower position.

Referring to FIGS. 3 and 4, the first preferred embodiment of a runner assembly according to the present invention is adapted for use in a prior known umbrella frame which includes a central shaft 100 that is elongated along an axis (L) in an axial direction and that has an engaging surface 110 facing upwardly, and a stretcher unit (not shown) that is disposed to move a rib unit (not shown) between partially and fully spread positions. The runner assembly is shown to comprise a tubular runner 10, a tubular retaining block 20, a tubular thrust member 30, and a retaining member 26.

The tubular runner 10 is adapted to be slidably sleeved on the central shaft 100, and includes an upper tubular end 11 which is coupled with the stretcher unit and which is movable between lower and upper positions that correspond to the partially and fully spread positions, respectively, and a lower tubular end 12 which is spaced apart from the upper tubular end 11 in the axial direction and which cooperates with the upper tubular end 11 to define an accommodation space 14. The accommodating space 14 defines a guideway that extends in a first direction (X) transverse to the axial direction. Specifically, the runner 10 includes front and rear guiding walls 111 which extend in the axial direction to interconnect the upper and lower tubular ends 11, 12, which are spaced apart from each other in a second direction transverse to both the axial direction and the first direction, and which cooperate with the lower tubular end 12 to define the guideway. In addition, the runner 10 further includes an annular seat 13 which is disposed on the lower tubular end 12 and which faces upwardly.

The tubular retaining block 20 is disposed in the accommodation space 14, surrounds the central shaft 100, and is configured to be guided by the front and rear guiding walls 111 to be moved along the guideway between first and second positions. The retaining block 20 includes leading and trailing wall segments 22, 21 spaced apart from each other in the first direction (X). The leading wall segment 22 is disposed ahead of the central shaft 100, and has an outer leading surface 221 which has a bump region 222 and a leveled region 223 that are proximate to and distal from the lower tubular end 12, respectively, and a slope 225 disposed between the bump and leveled regions 222, 223. The leading wall segment 22 further has an inner leading surface 224 confronting the central shaft 100. The trailing wall segment 21 trails behind the central shaft 100, and has an inner trailing surface 214 confronting the central shaft 100, and an outer trailing surface 211 which has a protruding follower region 213 and a trailing region 212 that are proximate to and distal from the upper tubular end 11, respectively.

The tubular thrust member 30 has an inner sleeve surface which is disposed to surround the retaining block 20, and which has front and rear slot regions 37 that respectively mate with the front and rear guiding walls 111 to be movable relative to the runner 10 and the retaining block 20 along the axis (L) between an actuating position, where the thrust member 30 is close to the upper tubular end 11, and a releasing position, where the thrust member 30 is remote from the upper tubular end 11. The inner sleeve surface includes an actuating surface segment 32 and a complementary surface segment 31 that respectively confront the outer trailing surface 211 and outer leading surface 221 in the first direction (X). The actuating surface segment 32 has head and cam regions 321, 322 disposed proximate to and distal from the upper tubular end 11, respectively, and a slope 323 disposed between the head and cam regions 321, 322. The complementary surface segment 31 has curb and recessed regions 311, 312 disposed proximate to and distal from the upper tubular end 11. In addition, the inner sleeve surface has an annular shoulder 36 disposed between the curb and recessed regions 311, 312.

The retaining member 26 is integrally formed with and is disposed on the inner trailing surface 214. In this embodiment, the retaining member 26 is disposed proximate to the upper tubular end 11.

When the runner 10 is in the lower position, as shown in FIG. 4, the retaining block 20 is in the first position, and the thrust member 30 is in the releasing position. Specifically, the bump region 222 abuts against the curb region 311, and the annular shoulder 36 abuts against the annular seat 13 so as to guard against downward movement of the thrust member 30 away from the releasing position. In addition, the follower region 213 is disposed in the head region 321, the trailing region 212 is in contact with the cam region 322, and the runner assembly is slidable on the central shaft 100 along the axis (L).

Figure 5:
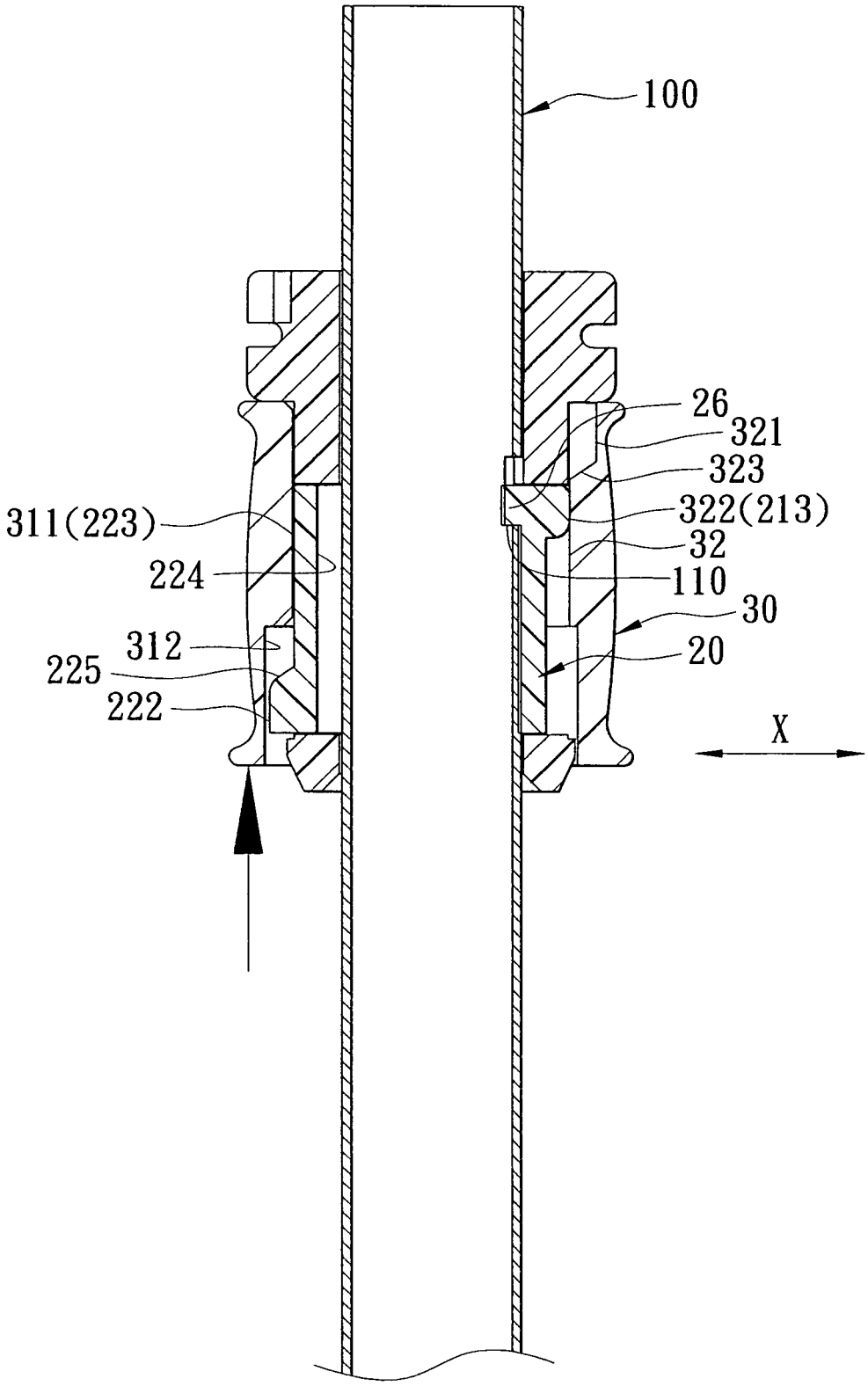
FIG. 5 is a sectional view of the first preferred embodiment, showing the runner in an upper position.

Referring to FIGS. 4 and 5, when the thrust member 30 is operated to move upwardly relative to the central shaft 100, i.e., when the thrust member 30 is moved from the releasing position to the actuating position, by virtue of the arrangement of the slope 323, the head region 321 can be smoothly moved over the follower region 213 to permit the cam region 322 to engage the follower region 213 and to apply a force to the retaining block 20 in the first direction (X) so as to shift the retaining block 20 from the first position to the second position. On the other hand, the bump region 222 is brought to slip over the curb region 311 to fall into the recessed region 312 so as to permit the retaining block 20 to be displaced to the second position. Once the retaining member 26 reaches the engaging surface 110 and is forced to engage the engaging surface 110, the retaining block 20 is moved to the second position, and the leveled region 223 is in frictional engagement with the curb region 311 to arrest the thrust member 30 in the actuating position. Thus, the retaining member 26 is retained with the engaging surface 110 to thereby guard against movement of the rib unit away from the fully spread position.

Furthermore, when the thrust member 30 is pulled downwardly to the releasing position, by virtue of the arrangement of the slope 225, the retaining block 20 can be moved smoothly to the first position, and the inner leading surface 224 is brought into contact with the central shaft 100 to limit the extent of movement of the retaining block 20 towards the first position.

As illustrated, the runner assembly according to this invention has the following advantages:

1. The runner 10, the retaining block 20, and the thrust member 30 are simple in construction, and are suitable for use with the central shaft 100 of a known umbrella frame.

2. Since the entire retaining block 20 is moved to the second position in the first direction (X) transverse to the axial direction along which the runner assembly is moved, the runner 10 can be firmly retained on the central shaft 100 in the upper position by virtue of engagement between the retaining member 26 and the engaging surface 110, between the cam and follower regions 322, 213, and between the leveled and curb regions 223, 311.

3. With the guiding walls 111 guiding the movement of the thrust member 30 along the axis (L) and with the movement of the retaining block 20 along the guideway, the operation of the runner assembly can be smooth and successful.

4. With the provision of the slopes 323, 225, the thrust member 30 can be operated to move the retaining block 20 smoothly.

Figure 6:
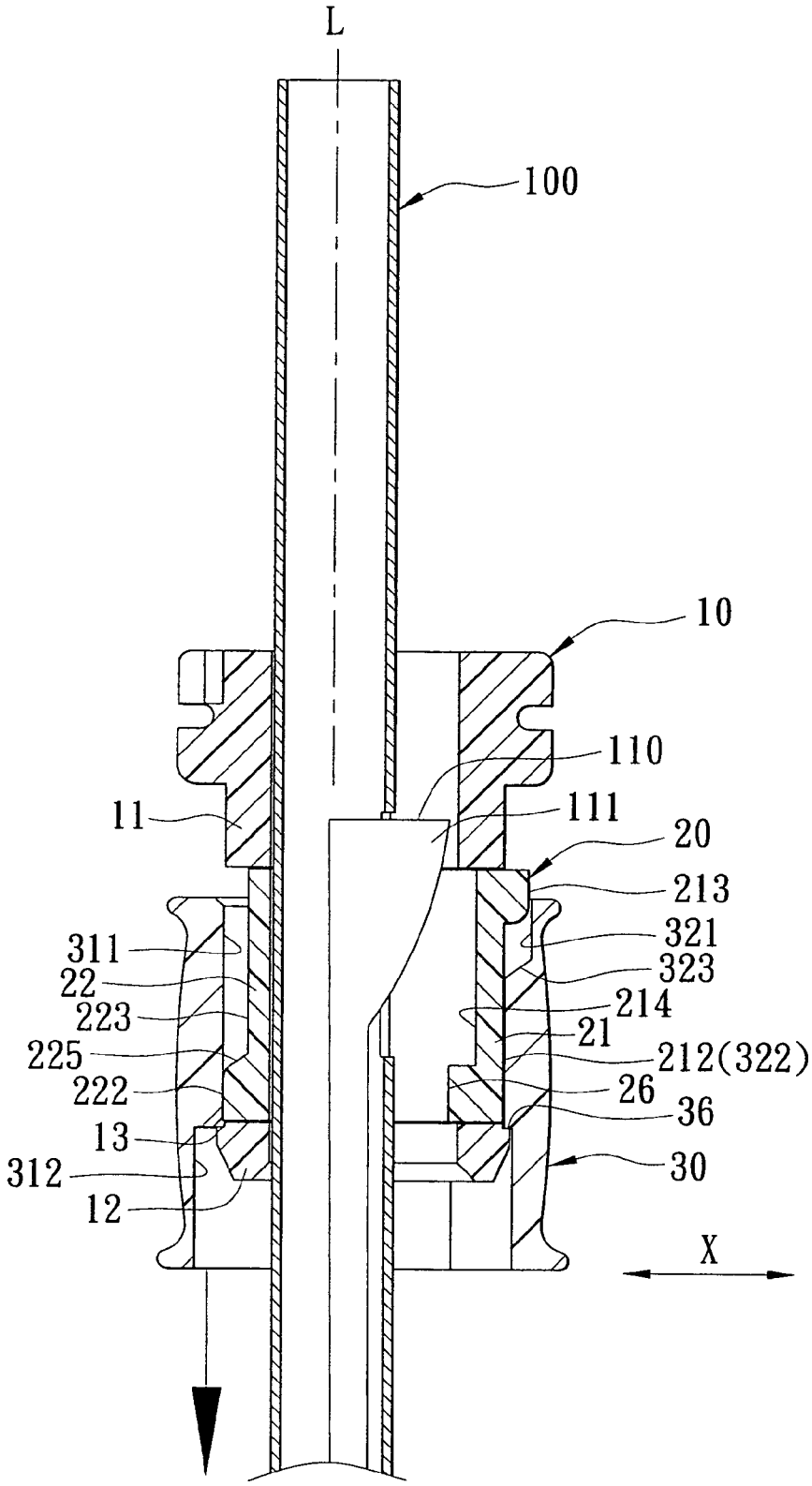
FIG. 6 is a sectional view of the second preferred embodiment of a runner assembly according to this invention, showing a runner in a lower position.
Figure 7:
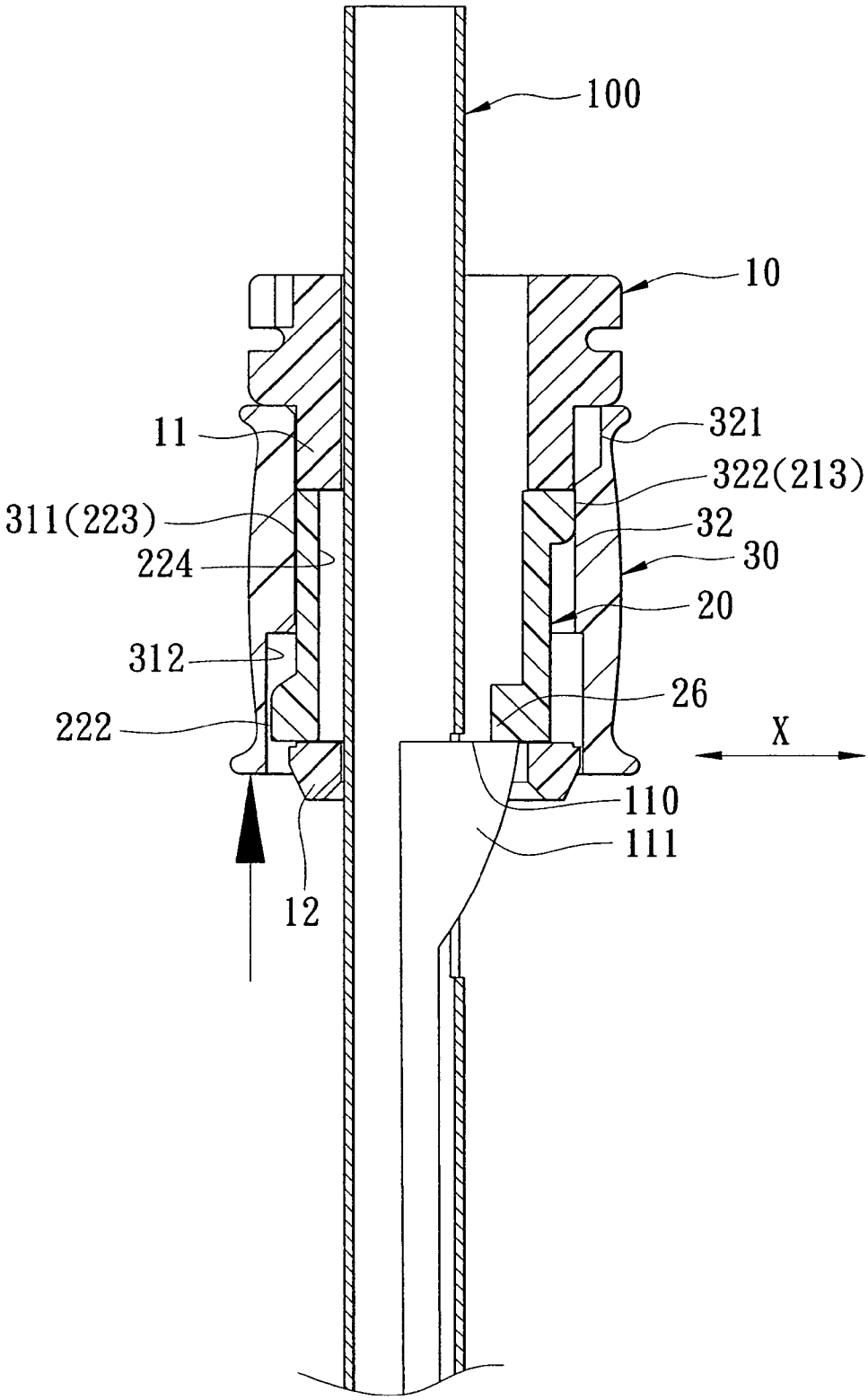
FIG. 7 is a sectional view of the second preferred embodiment, showing the runner in an upper position.

Referring to FIGS. 6 and 7, the second preferred embodiment of a runner assembly according to this invention is shown to be similar to the first embodiment in construction, and is adapted for use with a known central shaft 100 which has a biased bow 111 to form an upwardly facing engaging surface 110. The retaining member 26 is disposed proximate to the lower tubular end 12. Thus, the runner assembly according to this invention is suitable for use in any known umbrella frames.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

I claim:

1. A runner assembly for use in an umbrella frame which includes a central shaft that is elongated along an axis in an axial direction, and that has an engaging surface facing upwardly, and a stretcher unit disposed to move a rib unit of the umbrella frame between partially and fully spread positions, said runner assembly comprising:

a tubular runner adapted to be slidably sleeved on the central shaft, and including an upper tubular end which is adapted to be coupled with the stretcher unit and which is movable between lower and upper positions that correspond to the partially and fully spread positions, respectively, and a lower tubular end which is spaced apart from said upper tubular end in the axial direction and which cooperates with said upper tubular end to define an accommodation space therebetween, said accommodating space defining a guideway that extends in a first direction transverse to the axial direction;

a tubular retaining block which is adapted to surround the central shaft in said accommodation space, and which is configured to be guidingly movable along said guideway between first and second positions, said tubular retaining block including a leading wall segment disposed ahead of the central shaft in the first direction, and having an outer leading surface which has a bump region that is proximate to said lower tubular end, and a trailing wall segment spaced apart from said leading wall segment, and trailing behind the central shaft, said trailing wall segment having an inner trailing surface which confronts the central shaft, and an outer trailing surface which has a follower region proximate to said upper tubular end;

a tubular thrust member having an inner sleeve surface which is disposed to surround said retaining block, and which is configured to be movable relative to said tubular runner and said tubular retaining block between an actuating position, where said tubular thrust member is close to said upper tubular end, and a releasing position, where said tubular thrust member is remote from said upper tubular end, said inner sleeve surface including an actuating surface segment disposed to confront said outer trailing surface in the first direction, and having head and cam regions which are disposed proximate to and distal from said upper tubular end, respectively, and which are configured such that, when said tubular thrust member is moved from the releasing position to the actuating position, said head region is brought to move over said follower region so as to permit said cam region to engage said follower region to thereby shift said tubular retaining block from the first position to the second position, and a complementary surface segment disposed to confront said outer leading surface in the first direction, and having recessed and curb regions which are respectively distal from and proximate to said upper tubular end and which are configured such that, when said tubular retaining block is in the first position, said bump region abuts against said curb region, and such that, when said tubular thrust member is moved from the releasing position to the actuating position, said bump region is brought to slip over said curb region to fall into said recessed region so as to permit said tubular retaining block to be displaced to the second position; and a retaining member disposed on said inner trailing surface such that, when said tubular retaining block is displaced to the second position, said retaining member is brought into engagement with the engaging surface so as to be retained therewith, thereby guarding against movement of the rib unit away from the fully spread position.

2. The runner assembly according to claim 1, wherein said tubular runner includes front and rear guiding walls which extend in the axial direction to interconnect said upper and lower tubular ends, which are spaced apart from each other in a second direction transverse to both the axial direction and the first direction, and which cooperate with said lower tubular end to define said guideway such that said tubular retaining block is guided by said front and rear guiding walls to be moved between the first and second positions.

3. The runner assembly according to claim 1, wherein said leading wall segment has an inner leading surface which confronts the central shaft and which is brought into contact with the central shaft to limit extent of movement of said tubular retaining block towards the first position.

4. The runner assembly according to claim 1, wherein said outer leading surface has a leveled region which is distal from said lower tubular end and which is in frictional engagement with said curb region to arrest said tubular thrust member in the actuating position.

5. The runner assembly according to claim 1, wherein said outer trailing surface has a trailing region which is proximate to said lower tubular end and which is brought into contact with said cam region when said tubular retaining block is in the first position.

6. The runner assembly according to claim 1, wherein said retaining member is integrally formed with said inner trailing surface and is disposed proximate to said upper tubular end.

7. The runner assembly according to claim 1, wherein said retaining member is integrally formed with said inner trailing surface and is disposed proximate to said lower tubular end.

8. The runner assembly according to claim 1, wherein said tubular runner includes an annular seat which is disposed on said lower tubular end and which faces upwardly, said inner sleeve surface having an annular shoulder which is disposed between said curb and recessed regions and which abuts against said annular seat so as to guard against downward movement of said tubular thrust member away from the releasing position.

* * * * *